US009217225B2

(12) United States Patent
Michaud

(10) Patent No.: US 9,217,225 B2
(45) Date of Patent: Dec. 22, 2015

(54) PAPER MANUFACTURING

(75) Inventor: Gabriel Michaud, Laval (CA)

(73) Assignee: PAPRIMA INDUSTRIES INC., Dorval, QC (CA)

( * ) Notice: Subject to any disclaimer, the term of this patent is extended or adjusted under 35 U.S.C. 154(b) by 0 days.

(21) Appl. No.: 13/406,852

(22) Filed: Feb. 28, 2012

(65) Prior Publication Data

US 2013/0220564 A1 Aug. 29, 2013

(51) Int. Cl.
*D21F 1/66* (2006.01)
*D21F 7/00* (2006.01)

(52) U.S. Cl.
CPC ..... *D21F 7/006* (2013.01)

(58) Field of Classification Search
USPC ..... 162/264, 189, 194
See application file for complete search history.

(56) References Cited

U.S. PATENT DOCUMENTS

| | | | | |
|---|---|---|---|---|
| 4,231,272 | A | 11/1980 | Crouse | |
| 4,904,344 | A | 2/1990 | Peiffer | |
| 5,512,136 | A | 4/1996 | Altug et al. | |
| 5,759,350 | A | 6/1998 | Pyron et al. | |
| 5,785,814 | A | 7/1998 | Tang et al. | |
| 6,327,948 | B1 | 12/2001 | Tuori | |
| 6,524,443 | B2 | 2/2003 | Doelle et al. | |
| 6,740,200 | B2 | 5/2004 | Seymour et al. | |
| 6,918,996 | B2 | 7/2005 | Hasanen et al. | |
| 7,166,194 | B2 | 1/2007 | Straub et al. | |
| 2003/0183353 | A1 | 10/2003 | Helgesson et al. | |
| 2006/0169114 | A1 * | 8/2006 | Wilson | 83/24 |
| 2012/0241426 | A1 | 9/2012 | Caspar | |

FOREIGN PATENT DOCUMENTS

| | | | |
|---|---|---|---|
| EP | 0870583 | A2 | 10/1998 |
| FR | 840930 | | 1/1938 |
| GB | 391708 | A | 5/1933 |
| WO | WO 2009/022053 | A1 | 2/2009 |

OTHER PUBLICATIONS

PCT/CA2013/050141 international search report.
PCT/CA2013/050141 Written Opinion.
PCT/CA2013/050141 international preliminary report with related claims.

* cited by examiner

*Primary Examiner* — Jacob Thomas Minskey
(74) *Attorney, Agent, or Firm* — Anglehart et al.

(57) ABSTRACT

In a paper production machine, trim is cut at a trim station located near a final reel with a trim handling duct leading into a recycling pulper. The trim is propelled into the pulper using an air jet without using a source of vacuum in the duct. A linear air jet for propelling trim in a trim duct is also disclosed.

12 Claims, 3 Drawing Sheets

PAPER MANUFACTURING

TECHNICAL FIELD

The present application relates to paper manufacturing, and in particular to equipment and methods for handling trim.

BACKGROUND

Paper making machinery produces a web of paper. It is known to trim side edges of the web. It is known in the art to cut the trim using a blade, such as a rotary blade, or using a water jet. An overview of trim handling systems is described in the article, "Trim Handling Systems" presented at the TAPPI Papermaking Conference, Atlanta, Ga., 1999.

As described, trim conveying systems may be divided into five categories as follows:

1) a system for discharging the trim directly into a repulper below the winder, 2) an injector system, 3) a chopper fan system, 4) a combination shredder and transport fan system, and 5) a vacuum system.

Even in case (1) where the repulper is immediately below the winder area, the trim material is removed from the web using a duct or chute and a source of negative pressure to draw the trim into the duct or chute. The trim material is typically guided into the pulper of the paper making machine and immediately returned into producing paper.

Some paper making machines have web speeds well above 60 km/h, and in fact as high as 100 km/h to 140 km/h. At such speeds, a number of problems arise in edge trimming, for example, the stability of the web due to air turbulence, as is described in commonly-assigned PCT publication WO 2011/121390.

One such problem is the starting of trimming. When an untrimmed web is already in motion on the machine, the introduction or insertion of the cutting tool could disturb the web in a negative way. In some cases, bringing the tool in from the outside could cause the outer side edge to fold up. If the tool is brought down onto the web from above or below, not only must care be taken not to cause too much resistance on the web and crumple the web, but the trim must be carefully separated from the trim downstream of the cutting tool to allow the trim being cut from the web to go into duct or chute for recovery. If this separation is not done properly, the stability of the web can be jeopardized.

The separating of the trim can be done on slow webs by hand, however, this is not the case for high speed webs. It is known in the art to use a water jet system to separate the trim when the trimming tool engages the web. This typically involves using a number of small water jets placed across the trim width that are pulsed to cause a break in the trim (and not in the web). In the case of a water jet trim tool, the jet is positioned over the web, and the jet is turned on to begin the trim cutting. Very shortly thereafter, the separation of the trim from itself ensues.

The guiding of the trim into a handling chute, shaft or duct is done in paper making machines by connecting the duct to a source of suction. The flow rate of air drawn for such operation is considerable.

Applicants have used in a trim handling duct an air amplifier jet, at the outlet of the duct in an upper part of the repulper, to create a negative pressure in the duct to draw trim along the duct. The same system used additionally a pair of conical air jets to push trim into the inlet of the trim handling duct.

SUMMARY

It has been discovered that a wide air jet covering the width of the trim, namely a jet from an air knife or air wedge, can propel trim into a trim handling duct over distances of about 2 m to 3 m without the use of a vacuum source in the duct. The trim is efficiently carried and/or propelled by the air jet and pushed out the outlet of the duct into the pulper.

It has been discovered that trim can be propelled farther along a duct, or heavier trim can be propelled along a duct for the same distance, using additional air knives within the trim handling duct. This propulsion of trim within the duct can be done without use of a source of negative pressure in the duct.

In the case that the air jet is used both for separating the trim and for driving the trim into the duct or chute, it has been found that the air jet that is powerful enough to sever the trim is sufficiently strong to create a driving airflow that will guide the trim into a duct or along a chute over a distance sufficient for effective removal of the trim from the immediate area of web. The airflow created by the trim separating air jet can carry the trim at sufficient speed between one to five meters.

BRIEF DESCRIPTION OF THE DRAWINGS

The invention will be better understood by way of the following detailed description of embodiments of the invention with reference to the appended drawings, in which.

DETAILED DESCRIPTION

Figure 1:
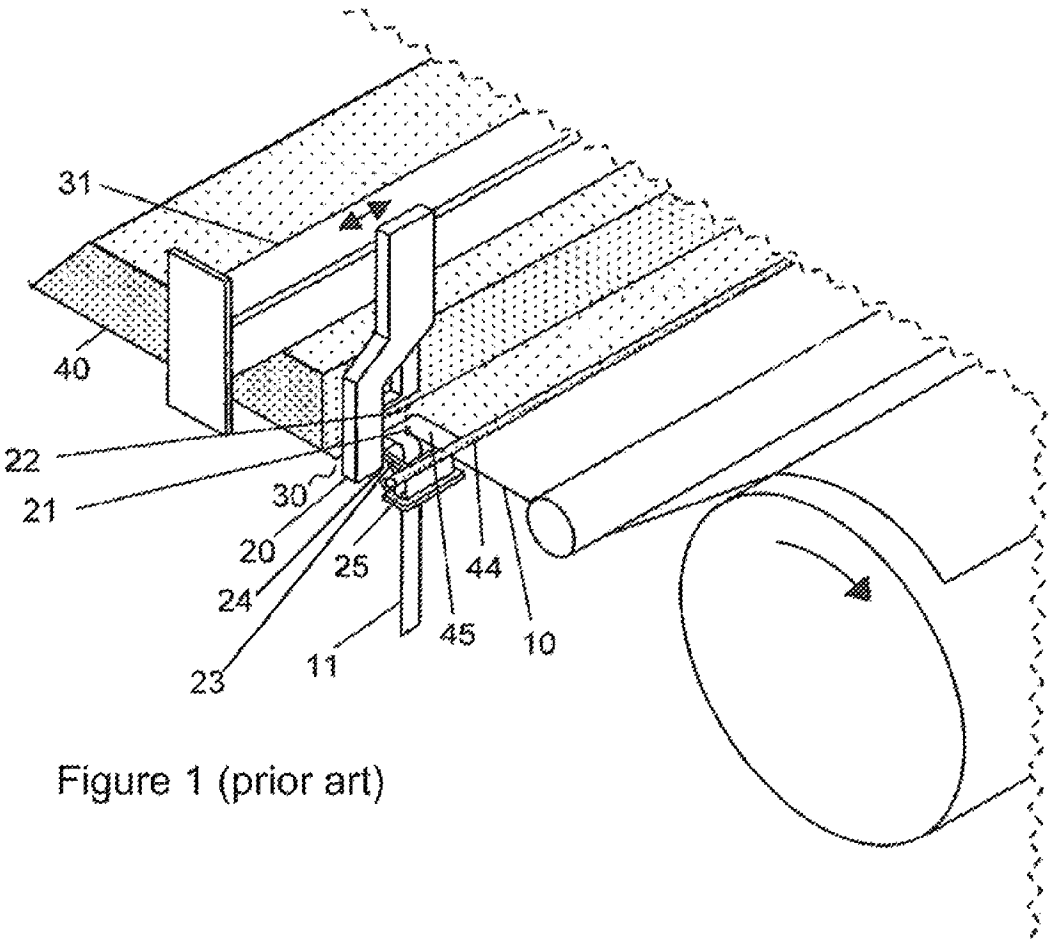
Figure 1 (prior art)
FIG. 1 illustrates a paper making machine having a web edge trimming apparatus in accordance with FIG. 9 of PCT publication WO 2011/121390.

FIG. 1 shows a three-dimensional sketch of a portion of a paper production installation according to PCT publication WO 2011/121390. A stabilizer 40 has attached thereto an apparatus for cutting a material web, which apparatus has an extension device 44 having a recess 45, and has a cutting device 20 (e.g. a water jet) and a cutting table 23 that has an optional inclined surface 24. The cutting device 20 and the cutting table 23, having an inclined surface 24 and a duct or shaft 25, again constitute a structural unit 30. There, the material web 10 runs through an edge trimming apparatus to a succeeding reel. Here, the apparatus for cutting a material web 10 consists of an air guide box or stabilizer 40 having a cutting device 20, which has an extension device 44. In addition, a recess 45 is provided in the extension device 44. The structural unit 30, via a carrier beam 31 mounted transversely over the material web 10, is arranged so as to be movable transversely in relation to the material web 10.

During operation of the apparatus, the material web 10 is severed by means of a high-pressure water jet 22. The resultant edge strip 11 is removed via the shaft 25 provided on the cutting table 23. The edge strip 11 in this case is already sliding into the shaft 25 because of the forward motion of the material web 10. In addition, the edge strip 11 is sucked away out of the plane of the material web and into the shaft 25 by a suction device attached to the shaft 25. The inclined surface 24 provided on the cutting table 23 effects additional stabilization of the material web 10 over the cutting table. In the case of a web loading operation, the structural unit 30, consisting of the cutting device 20 and the cutting table 23, and of the elements attached thereto, is moved laterally out of the recess 45 by means of the carrier beam 31. This structural unit 30 is then moved back into the transport path of the material web 10, in order to support the newly incoming and extending web.

Air jets that produce a wide and thin stream of air are known in the art. For convenience, in this specification, "linear air nozzle" and "linear air jet" are used to mean an air nozzle and an air jet air flow or stream respectively, such as an air knife or air wedge nozzle that produces a wide and thin stream at sufficient velocity to propel the paper trim.

An air knife is a tool used typically for cleaning surfaces of objects. The high velocity stream can be formed by arranging a number of small nozzles in a row or by having a nozzle orifice that is a slit. Air wedge nozzles have a row of small nozzles. The jets from the small nozzles blend together into the stream. High velocity air jets also induce ambient air around the nozzle to flow with the nozzle jet, an effect known as air amplification. The flow rate induced by an air amplifier nozzle can be many times the flow rate fed to the high velocity nozzle. An air wedge nozzle can be shaped to help air amplification flow. In the case of a slit nozzle, the slit can be uniform or provide greater airflow at the side ends of the stream for better stream stability.

While laminar flow is typically the goal in providing such a stream, the stream of air resulting from a wide nozzle will form a turbulent airflow with greater distance from the nozzle. Some air knife nozzles use the Coandă effect to help form the thin and wide stream, and are able to achieve efficient, high velocity streams. Whether such a thin stream can be sufficient for propelling trim into the duct opening can depend on trim speed and weight.

It would appear that the air flow near the nozzle is very effective in redirecting the trim into the duct. Further away from the nozzle, the air flow created by such nozzles has some turbulence, and it would appear that this turbulence helps transport trim material.

Figure 2:
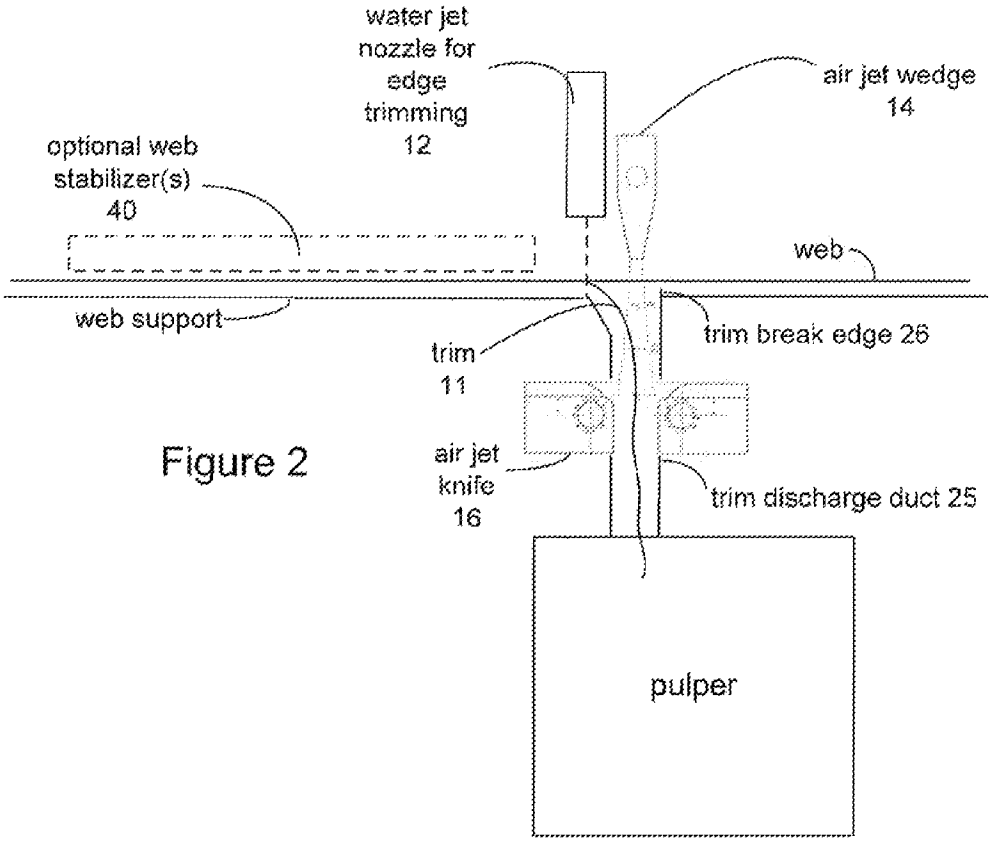
FIG. 2 illustrates a schematic side view (not to scale and not showing mountings) of one embodiment of the invention in which edge trimming is performed using a water jet (as in FIG. 1) in which the trim is pushed into the duct or shaft using forced air from a wedge nozzle, and the same air nozzle is used to cause an initial break in the trim to cause the trim to be guided into the duct.

In the embodiment of FIG. 2, the water jet cuts the edge trim, and the trim is pushed into the shaft or duct using a linear air jet 14. Applicants have used the Hurricane™ wedge 38150 from AiRTX of Cincinnati, Ohio, USA, and found it to work satisfactorily on tissue trim with an air supply at 40 psi (about 270 kPa) without using any suction in the duct. The airflow of the nozzle in this case is about 1470 liters per minute.

An AiRTX 80000 series air knife nozzle 16 was also arranged on both sides of the duct 25 used at 50 psi (about 325 kPa) and a flow of about 425 liters per minute to drive the trim within the duct. The wedge has a large number of small nozzle orifices and is shaped to create a strong inverted wedge-shaped air curtain that travels with good speed and distance. The air knife uses higher pressure and less air flow, however, its strong air curtain travels a shorter distance.

While the nozzles recited above worked well on tissue trim, it is expected that heavier paper trim can be handled efficiently with air nozzles.

The combined air flow of about 1900 liters per minute was found to be less than what is required to reliably handle the trim discharge using suction flow or even using a plurality of air nozzles with a shorter nozzle dimension in the transverse direction with respect to the web transport direction.

For example, an arrangement of two super air nozzles from Exair at 80 psi (550 kPa) and 14 CFM (400 liters per minute) each used to divert the trim into the duct, followed at the duct outlet by an AiRTX model 15000 air amplifier at 80 psi (550 kPa) and 60 CFM (1700 liters per minute) has been used by Applicant and shown to perform satisfactorily for trim handling from the trim station to a repulper immediately below the trim station. However, the three nozzles consume a total of 88CFM (2500 liters per minute), namely about 30% more compressed air flow. Furthermore, the air amplifier used induces suction in the duct, creating greater air flow through the duct into the repulper.

In FIG. 2, three air jet nozzles are provided, one wedge and two knife. It will be appreciated that other types of nozzle can be selected for the purpose of driving trim into the duct and/or performing the initial separation of the trim.

The use of the air knife jet, as illustrated in FIG. 2, is on both sides of the trim. This provides active air flow on both sides of the trim within the duct to transport the trim to its destination, for example, a pulper.

The duct can be substantially of rectangular cross-section as illustrated in FIG. 2. However, in some embodiments, the duct shape, while possibly initially rectangular, can transition to a circular cross-section duct. Furthermore, in some embodiments, the cross-section of the duct can be determined in accordance with an expected trim and air flow rate. For example, reducing a cross-sectional area will increase a flow speed, while this can result in a greater chance for blockage as the cross-sectional area of the duct decreases. Likewise, a decrease in flow speed of trim can lead to a pile up of trim and blockage of the duct. The design of the duct and the provision of the air jets are selected to provide efficient carriage of the trim without blockage.

In the embodiment illustrated in FIG. 2, the air wedge is mounted within 3 cm to 15 cm from the cutting water jet. When the trim is initially separated, the air wedge can have sufficient force to break the trim held under tension, or the air wedge can cause a break in the trim by forcing the trim against the downstream edge of the duct opening. Alternatively, a water spray can be applied to the trim to weaken it prior to causing the break and separation.

As shown in FIG. 2, the pulper is located below the cutting station near the winder. The duct can be straight or it can involve one or more bends before reaching the pulper.

Figure 3:
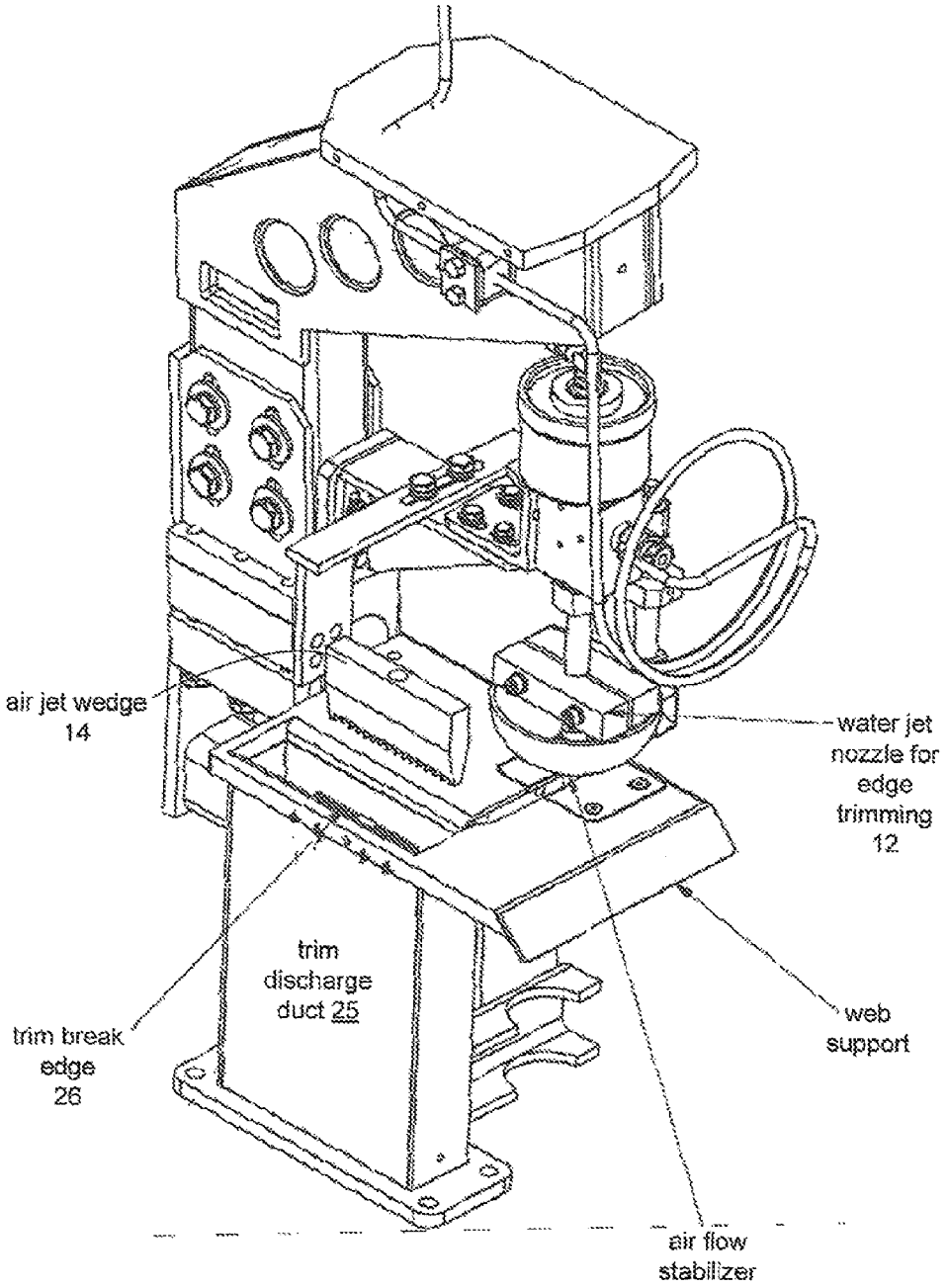
FIG. 3 illustrates a perspective view of the embodiment of FIG. 2.

In the perspective view of FIG. 3, the trim cutting water jet 12 is shown with a bowl-shaped air flow stabilizer. The web support surface forms part of the remaining web support surface of the paper making machine. The air wedge 14 is positioned above the inlet to the trim discharge duct 25 having a break edge 26 on its downstream side. At the beginning of a production cycle, the trim cut by the jet 12 is initially separated from the web by turning on the wedge nozzle 14 with the result that the trim is pushed into the duct inlet against the edge 26. The trim is thereby torn and the air stream from wedge 14 propels the trim into and along duct 25.

While in the embodiment of FIGS. 2 and 3, transport of the trim in the duct takes place without using a source of negative pressure, it will be appreciated that it can be efficient to use a source of negative pressure, such as a suction fan or blower, to help carry trim along the duct.

While a linear jet has been shown to be particularly efficient in propelling trim into the duct, in some embodiments, the air jet propelling trim into the duct can be conical or of other configuration, while the trim is propelled to a discharge end of the duct into a repulper near the trim station (namely less than about 5 m of duct), without needing a source of suction or negative pressure.

What is claimed is:

1. A method of producing paper in which a web of paper is prepared and conveyed toward a final reel, the method comprising:

trimming at least one side edge of the paper web to produce trim conveyed by a duct for recycling, the duct being an enclosed conduit having an inlet at one end and an outlet at the other end;

using at least one linear air jet positioned over said duct and acting on said trim downstream and near a location of trimming to propel said trim into the inlet of said duct, said at least one linear air jet being transversely oriented with respect to both the web of paper and a cross-section of said duct at its inlet;

carrying said trim by said at least one linear air jet along a predetermined distance within the enclosed conduit of said duct without a source of suction; and feeding said web after trimming toward said final reel.

2. The method as defined in claim 1, further comprising:

at the onset of trimming, using said linear air jet to initially break said trim so that said trim can begin to move into said duct.

3. The method as defined in claim 2, wherein said inlet has a trim breaking edge on a downstream side thereof, said breaking using said trim breaking edge.

4. The method as defined in claim 1, wherein said linear air jet is used to propel said trim from said inlet to said outlet of said duct without a source of suction.

5. The method as defined in claim 4, wherein said trim is directed into a recycling pulper at a distance less than 4.5 m from said inlet of said duct.

6. The method as defined in claim 1, wherein said trim is further propelled by a pair of linear air jets arranged on both sides of said trim in said duct.

7. The method as defined in claim 1, wherein said trim is further propelled by at least one further air jet arranged at said outlet of said duct.

8. A method of producing paper in which a web of paper is prepared and conveyed toward a final reel with at least one side edge of the web being trimmed to produce trim conveyed by a duct for recycling, the method comprising:

using at least one air jet positioned over said duct and acting on said trim downstream and near a location of trimming to propel said trim into an inlet of said duct, said air jet being transversely oriented with respect to both the web of paper and a cross-section of said duct at its inlet;

carrying said trim by said air jet within an enclosed conduit of said duct, from said inlet to a discharge of said duct, without a source of suction, said trim is directed into a recycling pulper at a distance less than about 5 m from said inlet of said duct; and feeding said web after trimming toward said final reel.

9. The method as defined in claim 8, wherein said trim is further propelled by a pair of linear air jets arranged on both sides of said trim in said duct.

10. An apparatus for handling trim in a paper production machine having a trim station, said apparatus comprising:

a duct, said duct being an enclosed conduit having an inlet at one end and an outlet at the other end, wherein no source of suction is provided within the enclosed conduit of said duct;

at least one linear air jet mounted over said duct for acting on said trim downstream and near a location of trimming to propel said trim into an inlet of said duct and to carry said trim along a predetermined distance within said enclosed conduit of said duct, said at least one linear air jet being transversally oriented with respect to both said trim and a cross-section of said duct at its inlet.

11. The apparatus as claimed in claim 10, wherein a recycling pulper is located at said discharge of said duct and said duct has a length less than 4.5 m.

12. An apparatus for handling trim in a paper production machine having a trim station located near a final reel with a trim handling duct leading into a recycling pulper, the apparatus comprising:

a duct having a length less than about 4.5 m, said duct being an enclosed conduit having an inlet at one end and a discharge at the other end;

at least one air jet mounted over said duct for acting on said trim downstream and near a location of trimming to propel said trim into said inlet of said duct, said at least one air jet being transversally oriented with respect to both said trim and a cross-section of said duct at its inlet;

wherein no source of suction is provided within the enclosed conduit of said duct, said air jet being used to propel said trim from said inlet to said discharge of said duct into said recycling pulper.

* * * * *